US007537468B1

(12) United States Patent
Huang et al.

(10) Patent No.: US 7,537,468 B1
(45) Date of Patent: May 26, 2009

(54) ELECTRIC SOCKET

(76) Inventors: Fu-Hsiang Huang, No. 116, Ging Zai Lane, Sec. 3, Zhongshan Rd., Wuri Shiang, Taichung County 414 (TW); Chang-Chin Yang, No. 33, Tongping Lane, Beitun District, Taichung City 406 (TW); Chih-Pin Yang, No. 33-1, Tongping Lane, Beitun District, Taichung City 406 (TW); De-Lin Jan, No. 109, Dalong Rd., Nantun District, Taichung City 408 (TW)

( * ) Notice: Subject to any disclaimer, the term of this patent is extended or adjusted under 35 U.S.C. 154(b) by 0 days.

(21) Appl. No.: 12/179,908

(22) Filed: Jul. 25, 2008

(30) Foreign Application Priority Data

Dec. 14, 2007 (TW) ..... 96221362 U

(51) Int. Cl.
*H01R 13/44* (2006.01)

(52) U.S. Cl. ..... 439/135; 439/188

(58) Field of Classification Search ..... 439/188, 439/135, 535; 200/51 R, 51.09
See application file for complete search history.

(56) References Cited

U.S. PATENT DOCUMENTS 3,868,160 A * 2/1975 Kersman ..... 439/188
4,230,386 A * 10/1980 Farnworth et al. ..... 439/188
4,283,102 A * 8/1981 Richier ..... 439/188
4,932,886 A * 6/1990 Glaser ..... 439/137
5,551,884 A * 9/1996 Burkhart, Sr. ..... 439/140
6,229,107 B1 * 5/2001 Flint et al. ..... 200/51.09

* cited by examiner

*Primary Examiner*—Khiem Nguyen
(74) *Attorney, Agent, or Firm*—Browdy and Neimark, P.L.L.C.

(57) ABSTRACT

An electric socket includes a base provided with two electrodes and conduction members beside the electrodes. Each of the conduction members is connected to a power source and keeps a predetermined distance away from the electrodes. An upper casing has two apertures corresponding to the electrodes respectively. A power control unit includes a control block beside the conduction members and a control shaft having an end connected to the control block and an opposite end extended out of the upper casing. Two shutter members are pivoted on the base to shut the aperture. When a plug is inserted into the electric socket of the present invention, prongs of the slug will move away the shutter first, and then press the control shaft to make the control block bending the conduction members toward the electrodes that makes the conduction members contacting the electrodes respectively.

7 Claims, 6 Drawing Sheets

ELECTRIC SOCKET

BACKGROUND OF THE INVENTION

1. Field of the Invention

The present invention relates to an electric socket and more particularly, to an electric socket including a main member, a power control unit, electrodes, and power conduction members. The power conduction members will contact the electrodes to conduct electricity to the electrodes when a plug is inserted. The electrodes are power disconnected for safety. The power control unit is provided with a shutter member that the shutter member is opened only when the plug is inserted, and shuts the apertures in rest of time to block dust and moisture out.

2. Description of the Related Art

Typically, conventional electric sockets are provided with no security control device. They only allow plugs inserted therein. In other words, children may get an electric shock when he/she inserts metal wires or other improper thing into the conventional electric socket. The apertures of the conventional electric socket are open all the time that dust may enter and affect the conduction. The serious problem is when water flows into the aperture that may cause electricity short or leakage. Some conventional electric sockets are connected with a circuit to control the power connection and disconnection in setting conditions. The main problem of such electric sockets is the cost too high and large size to be connected to the common sockets mounted on a wall.

SUMMARY OF THE INVENTION

The primary objective of the present invention is to provide an electric socket, which the power is connected only when the plug is inserted, and the power is disconnected in rest of time.

To achieve this objective of the present invention, an electric socket includes a base provided with a plurality of electrodes and conduction members beside the electrodes. Each of the conduction members is connected to a power source and keeps a predetermined distance away from the electrode in a normal condition. An upper casing has a plurality of apertures corresponding to the electrodes respectively. A power control unit includes a control block beside the conduction members. The control block is moved to bend the conduction members toward the electrodes and makes the conduction members contacting the electrodes respectively.

DETAILED DESCRIPTION OF THE INVENTION

Figure 1:
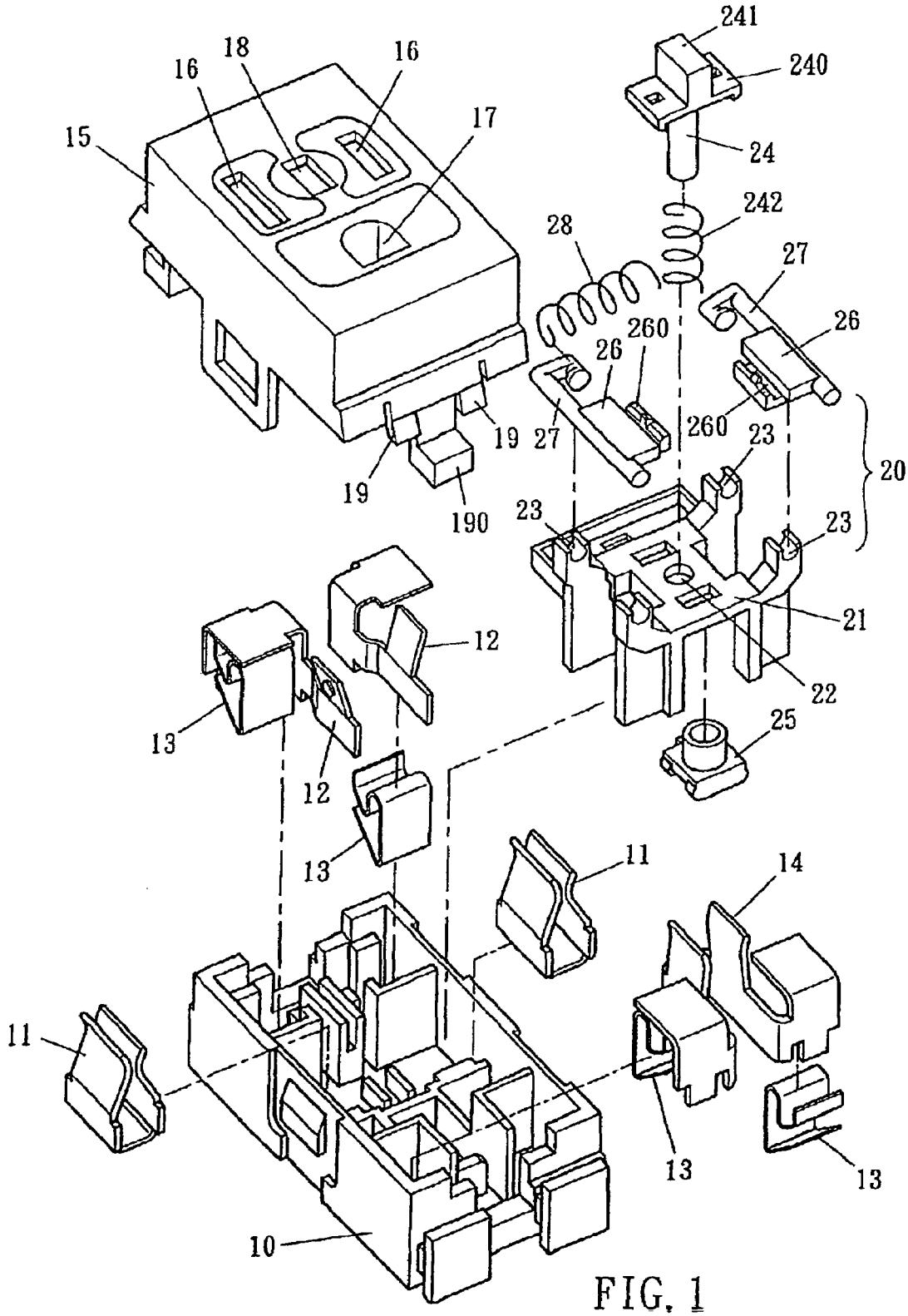
FIG. 1 is an exploded view of a preferred embodiment of the present invention.
Figure 2:
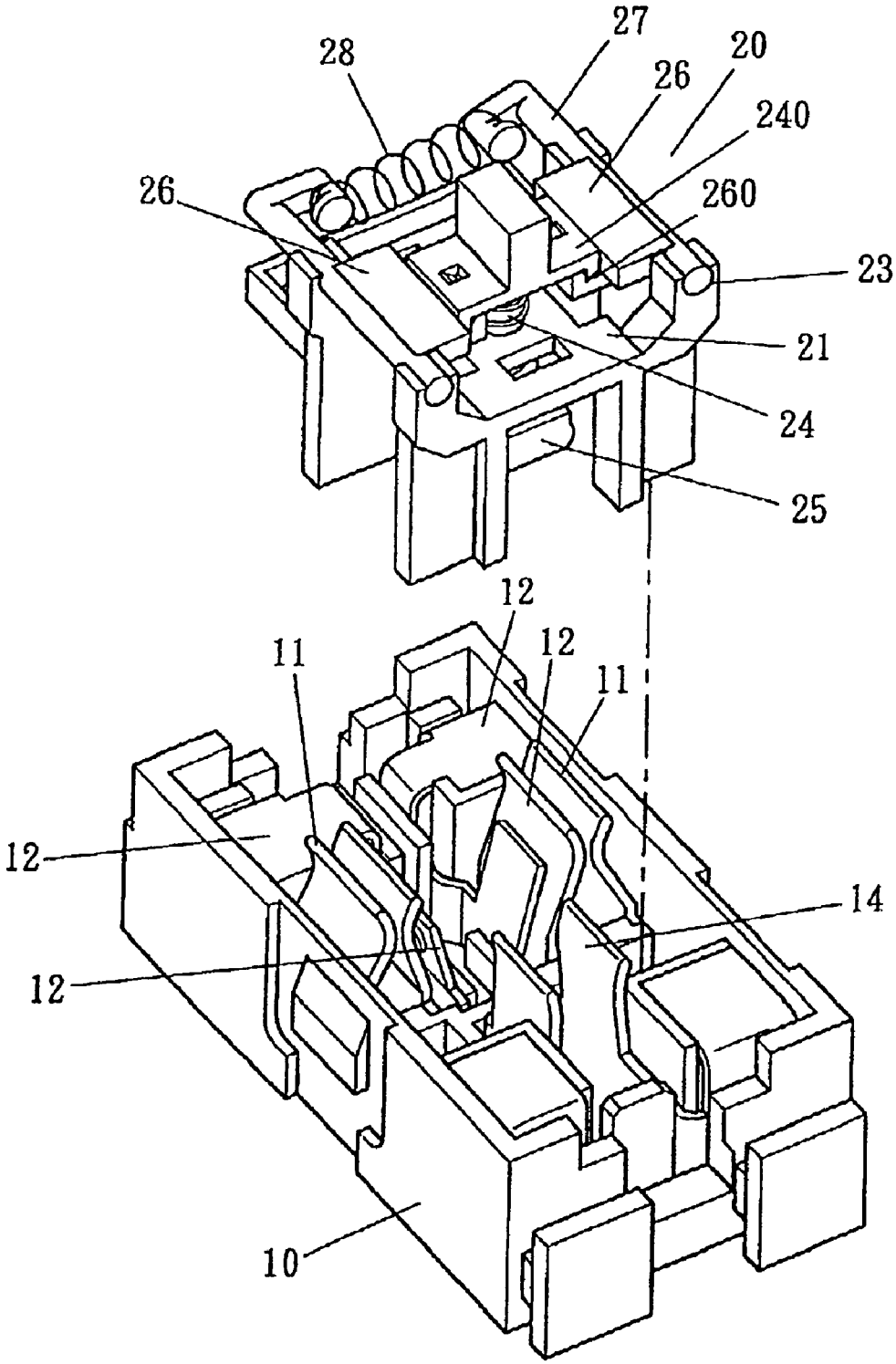
FIG. 2 is an exploded view of the base and the power control unit of the referred embodiment of the present invention.

Referring to FIGS. 1~8, an electric socket of the preferred embodiment of the present invention mainly includes a base 10, an upper casing 15, and a power control unit 20. The base 10 includes two electrodes 11, a ground electrode 14, two wire securing members 13, and two conduction members 12 connected to the wire securing members 13 respectively. The conduction members 12 are located beside the electrodes 11 and keep a distance from the electrodes 11 respectively. In other words, the electrodes 11 are power disconnected in a normal condition. The upper casing 15 includes two apertures 16, a ground aperture 17, and a bore 18. The power control unit 20 is provided with a control shaft 24 and a control block 25. The control shaft 24 includes a block 241 extended out of the upper casing 15 via the bore 18. The control block 25 is provided on a bottom end of the control shaft 24 and is located between the conduction members 12. When a plug 16 is inserted, the plug 16 will press the block 241 of the control shaft 24 downwards that the control block 25 will bend the conduction members 12 toward the electrodes 11 respectively. As a result, the conduction members 12 contact the electrodes 11 respectively to conduct the power. The power control unit 20 includes a position base 21 mounted in the base 10, which has a hole 22 for the control shaft 24 passing through. A spring 242 is fitted to the control shaft 24 that the control shaft 24 and the control block 25 may be moved up and down along the hole 22. On the position base 21 of the power control unit 20 two pair of axle seats 23. Two shutter members 26 are provided on the position base 21, each of which has an axle 27 received in the axle seats 23. A spring 28 is connected to the axles 27 of the shutter members 26. Each of the shutter members 26 has a slot 260 thereon. The control shaft 24 is provided with two protrusions to be engaged with the slots 260 when the shutter members 26 shut the apertures 16. The shutter members 26 will be moved away from the apertures 16 when the plug is inserted. The upper casing 15 is provided with two lock blocks 19, each of which has a control block 190 to be pressed to move the lock blocks 19.

The conduction members 12, the wire securing members 13, the electrodes 11, and the ground electrode 14 of the present invention are made of copper for electricity conduction. The control shaft 24, the shutter members 26, the position seat 21, and the control block 24 of the power control unit 20 of the present invention are made of plastic for electricity insulation.

Figure 3:
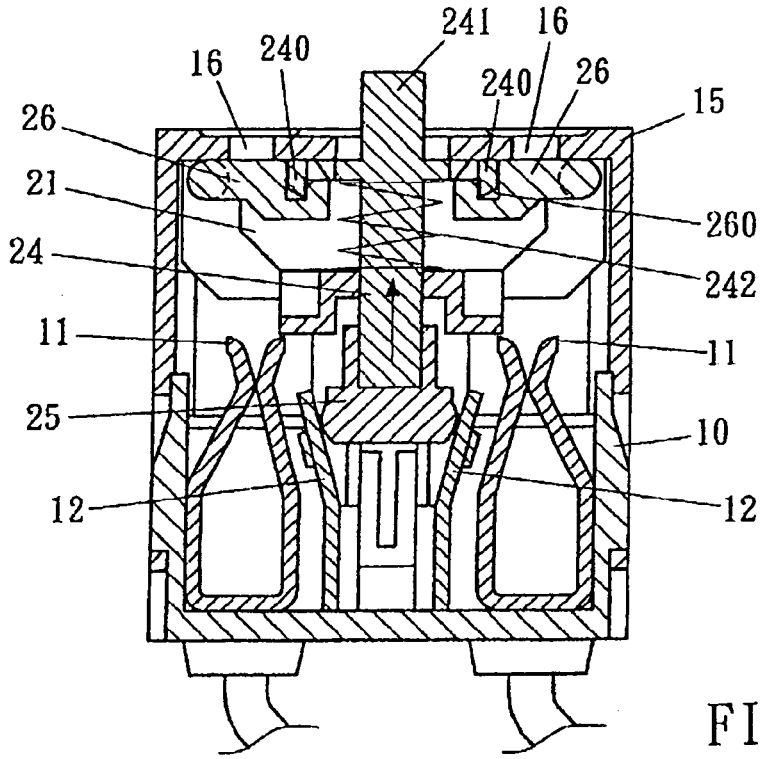
FIG. 3 is a sectional view of the referred embodiment of the present invention, showing the power disconnected condition.

As shown in FIG. 3, in a normal condition, wires (not shown), which connected to a power source, are connected to the wire securing members 13 that the conduction members 12 is connected to the power source via the wire securing members 13. The block 241, the control shaft 24, and the control block 25 are elevated by the spring 242 that the control block 25 does not touch the conduction members 12. The conduction members 12 keep distances from the electrodes 11 that the electrodes 11 have no electricity. The shutter members 26 shout the apertures 16 of the upper casing 15.

Figure 4:
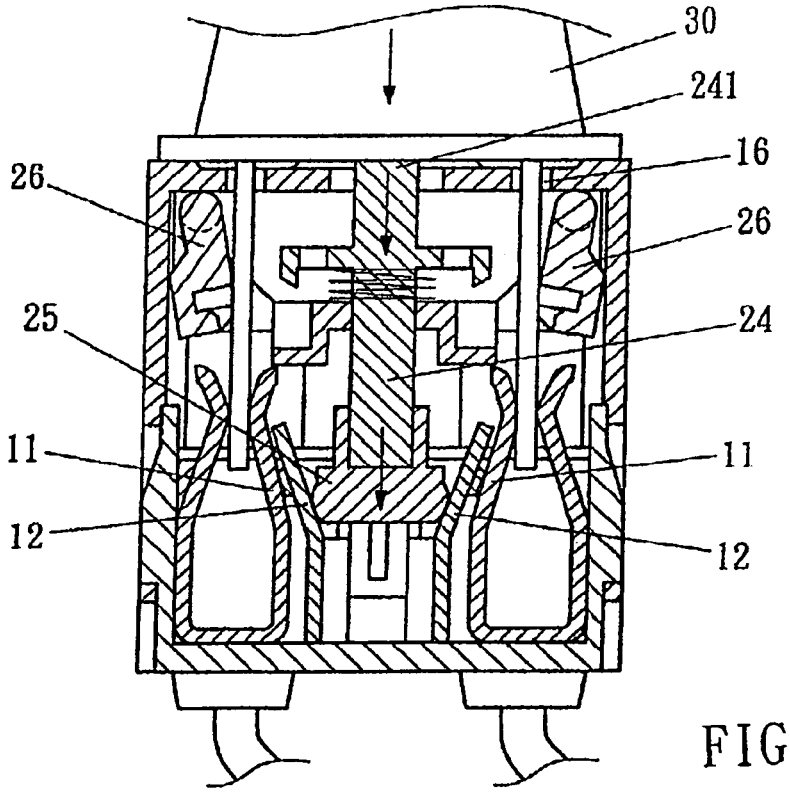
FIG. 4 is a sectional view of the referred embodiment of the present invention, showing the power connected condition when the plug is inserted.

As shown in FIG. 4, when a plug 30 is about to be inserted into the electric socket of the present invention, prongs of the plug 30 will enter the apertures 16 and move away the shutter members 26. And then, the plug 30 will press the block 241 downwards that the control block 25 will be moved downwards to bend the conduction members 12 toward the electrodes 12 respectively. As a result, the conduction members 12 will contact the electrodes 12 to conduct electricity thereto. By the end of insertion of the plug 30, the prongs will contact the electrodes 12 for electricity conduction. When the plug 30 is pulled out, the control shaft 24 and the control block 25 will be elevated by the spring 242 that the conduction members 12 will leave the electrodes 12 to disconnect the power again, as shown in FIG. 3.

Figure 5:
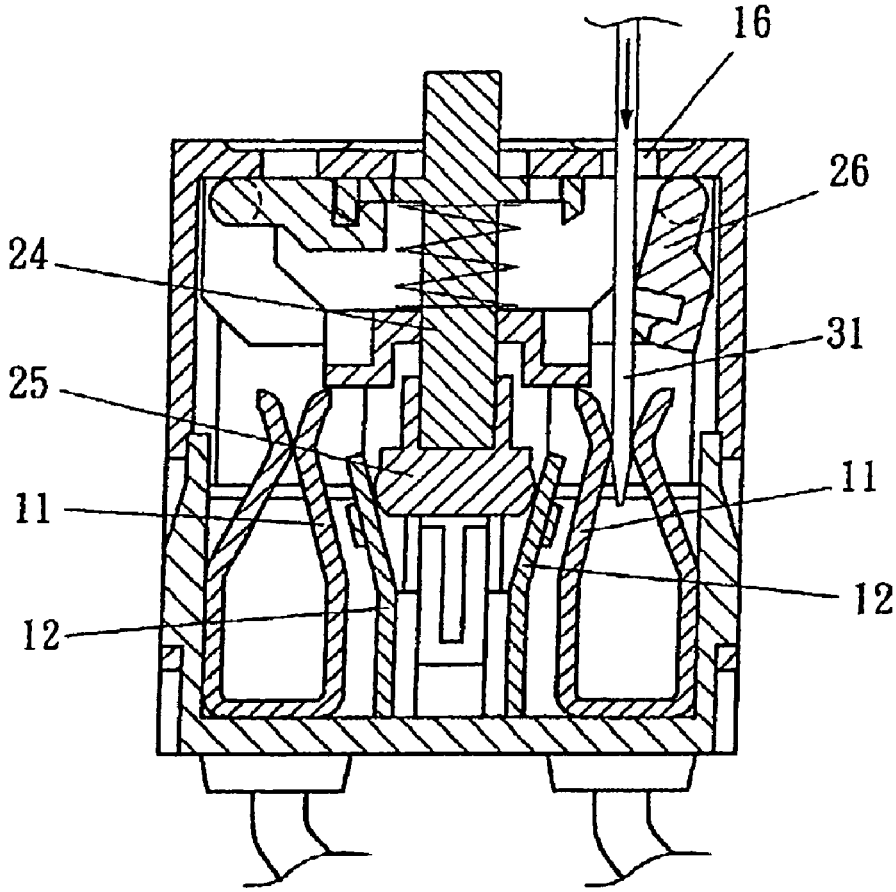
FIG. 5 is a sectional view of the referred embodiment of the present invention, showing the power disconnected condition when an improper thing is inserted.
Figure 6:
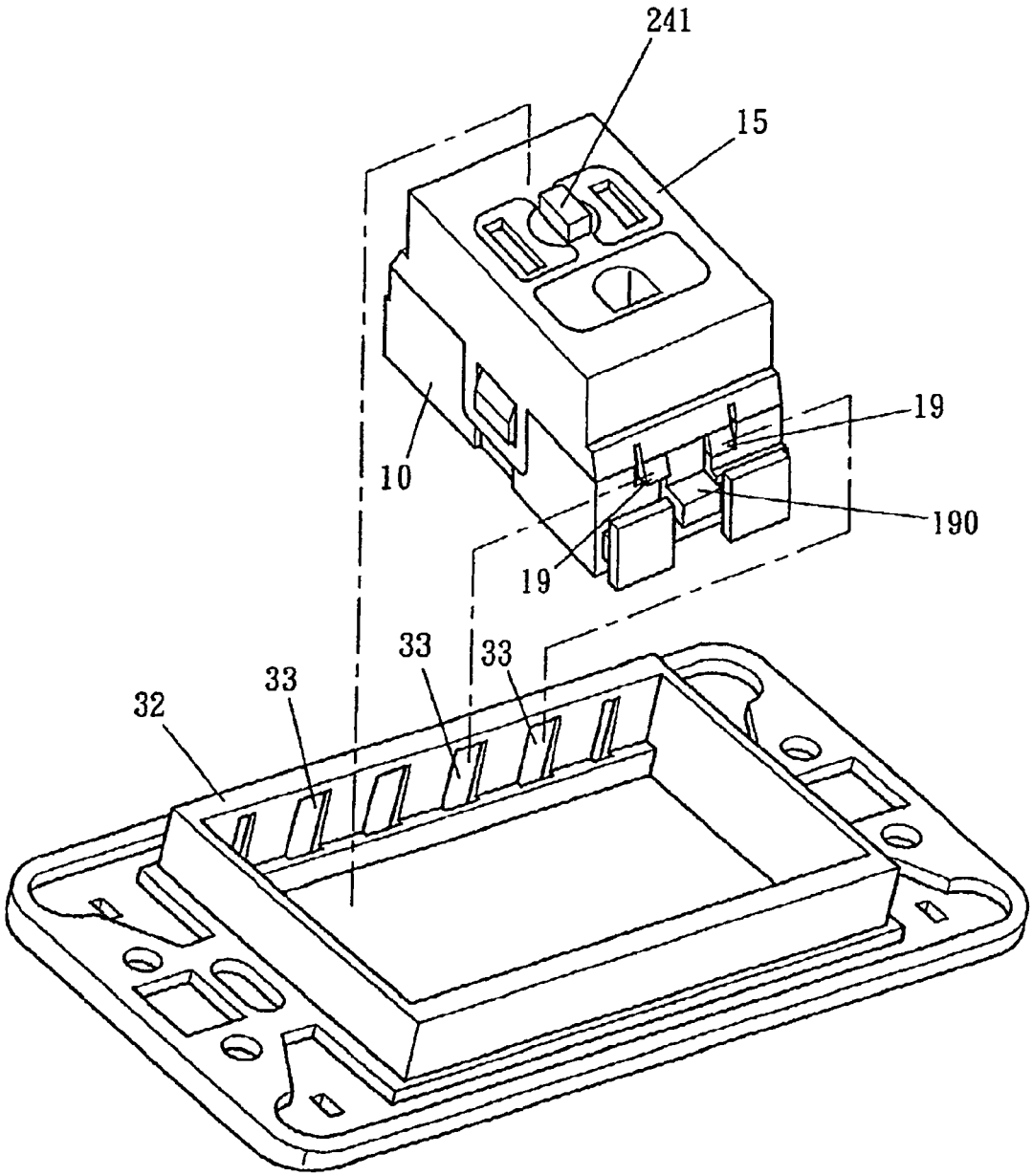
FIG. 6 is a perspective view of the referred embodiment of the present invention, showing the electric socket of the present invention mounted on the frame.

When a child inserts a metal wire 31 into the aperture 16, as shown in FIG. 5, the metal wire 31 may touch the electrode 11 but the child will not get electricity shock because the electrodes 11 have no electricity in the normal condition.

When one presses the block 241 of the control shaft 24 by finger rather than inserts a plug into the electric socket of the present invention, the shutter members 26 keep at the position of shutting the apertures 16 that the shaft 24 will be stopped by the engagement of the protrusions 240 and the slots 261 of the shutter members 26, as shown in FIG. 3. In other words, the block 241 of the control shaft 24 may be pressed downwards only when both of the shutter members 26 are swung downwards for disengagement of the protrusions 240 and the slots 261.

Figure 7:
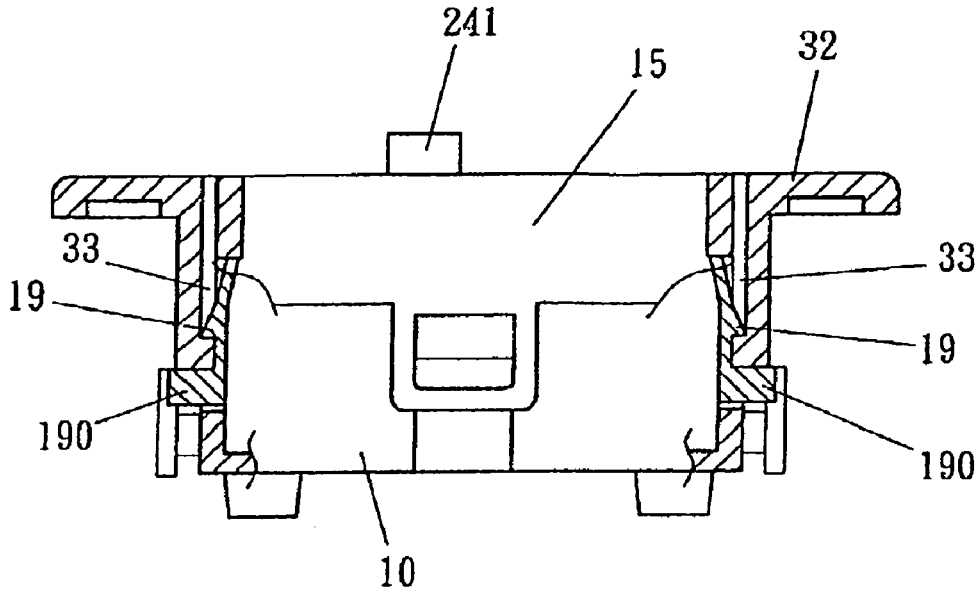
FIG. 7 is a sectional view of the referred embodiment of the present invention, showing the electric socket secured with the frame.
Figure 8:
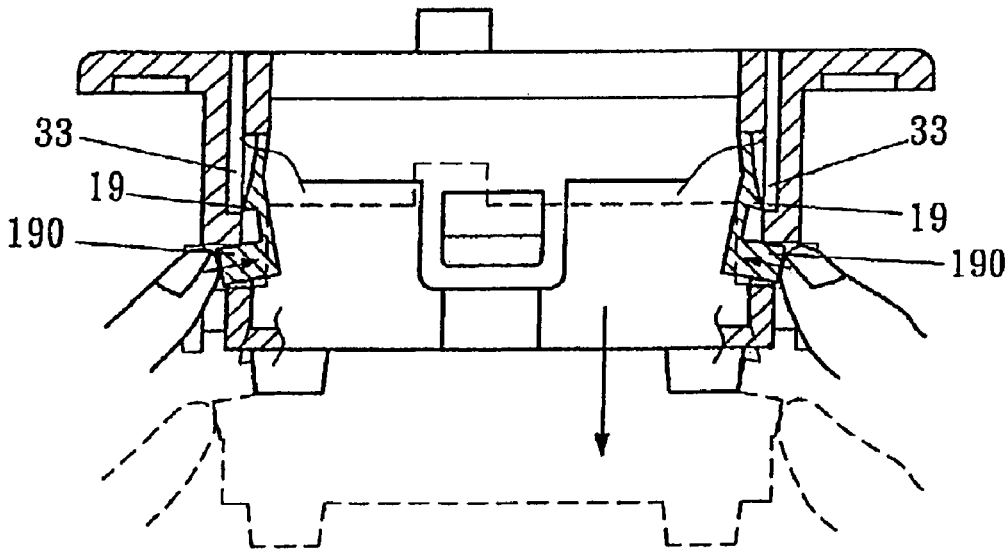
FIG. 8 is a sectional view of the referred embodiment of the present invention, showing the electric socket disengaged with the frame.

The electric socket of the present invention may be mounted on a frame 32. The lock blocks 19 on the upper casing 15 may be engaged with the frame 32, as shown in FIG. 7. Fir disconnection of the electric socket and the frame 32, one may press the control blocks 190 to bend the lock blocks 19 inwards for disengagement of the lock blocks 19 and lock slots 33 of the frame 32 without any tool involved.

In conclusion, the electric socket of the present invention is provided with the conduction members that conduct power to the electrodes only when a plug is inserted. No matter when a child inserts improper thing into the electric socket of the present invention or only the block is pressed rather than the plug is inserted, the present invention provides the corresponding solution to prevent electricity shock.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. An electric socket, comprising:

a base provided with a plurality of electrodes and conduction members beside said electrodes, wherein each of said conduction members is connected to a power source and keeps a predetermined distance away from said electrode in a normal condition;

an upper casing having a plurality of apertures corresponding to said electrodes respectively;

a power control unit including a control block beside said conduction members, wherein said control block is moved to bend said conduction members toward said electrodes and makes said conduction members contacting said electrodes respectively; and a plurality of shutter members pivoted on said base and a spring, wherein each of said shutter members is under said apertures of said upper casing to shut said apertures and may be moved away from said apertures, and said spring urges said shutter members to positions of shutting said apertures, wherein said power control unit includes a protrusion in association with said shutter member that said power control unit is stopped by said shutter member when said shutter member is located at the position of shutting said aperture, and said power control unit is free to be moved only when said shutter member is moved away from said aperture.

2. The electric socket as claimed in claim 1, wherein said power control unit further includes a control shaft connecting said control block and having an end extended out of said upper casing and a spring urging said control shaft to have said control block leaving said electrodes in said normal condition.

3. The electric socket as claimed in claim 1, said shutter member includes a slot to be engaged with said protrusion of said power control unit.

4. The electric socket as claimed in claim 1, wherein said control block has inclined face in association with said electrodes respectively.

5. The electric socket as claimed in claim 1, further comprising a frame detachably connected to said upper casing.

6. The electric socket as claimed in claim 5, wherein said upper casing has at least a block, and said frame has at least a slot to be engaged with said lock block.

7. The electric socket as claimed in claim 6, wherein said lock block has a control block to be pressed for disengaging said lock block and said slot.

* * * * *